US010207843B2

(12) United States Patent
Choi

(10) Patent No.: US 10,207,843 B2
(45) Date of Patent: Feb. 19, 2019

(54) CONTAINER STOPPER HAVING MULTI-LOCK STRUCTURE

(71) Applicant: CJ Cheiljedang Corporation, Seoul (KR)

(72) Inventor: Min Seok Choi, Seoul (KR)

(73) Assignee: CJ Cheiljedang Corporation, Seoul (KR)

( * ) Notice: Subject to any disclaimer, the term of this patent is extended or adjusted under 35 U.S.C. 154(b) by 0 days.

(21) Appl. No.: 15/538,070

(22) PCT Filed: Dec. 29, 2015

(86) PCT No.: PCT/KR2015/014430
§ 371 (c)(1),
(2) Date: Dec. 27, 2017

(87) PCT Pub. No.: WO2016/108590
PCT Pub. Date: Jul. 7, 2016

(65) Prior Publication Data

US 2018/0127163 A1 May 10, 2018

(30) Foreign Application Priority Data

Jan. 2, 2015 (KR) ..... 20-2015-0000001 U

(51) Int. Cl.
*B65D 43/22* (2006.01)
*B65D 47/08* (2006.01)
(Continued)

(52) U.S. Cl.
CPC ..... *B65D 43/22* (2013.01); *B65D 39/00* (2013.01); *B65D 39/0052* (2013.01);
(Continued)

(58) Field of Classification Search
CPC .. B65D 43/22; B65D 43/169; B65D 39/0052; B65D 51/18; B65D 47/0857;
(Continued)

(56) References Cited

U.S. PATENT DOCUMENTS 3,924,768 A * 12/1975 Lemons ..... B65D 55/10 215/213
4,010,875 A * 3/1977 Babiol ..... B65D 47/148 222/517
(Continued)

FOREIGN PATENT DOCUMENTS

JP S49-013223 U 2/1974
JP S56-043776 U 4/1981
(Continued)

OTHER PUBLICATIONS

International Application Status Report for PCT/KR2015/014430, dated Jan. 11, 2016, 2 pages.
(Continued)

*Primary Examiner* — Kareen K Thomas
(74) *Attorney, Agent, or Firm* — Adsero IP

(57) ABSTRACT

The present invention relates to a container stopper having a multi-lock structure in which a multi-lock structure is applied to the inner circumferential surface of an opening of a lower stopper, and to the outer circumferential surface of a sealing protrusion of an upper stopper coupled thereto, thereby preventing the coupled stoppers from being easily opened due to shock or other external force generated during the distribution process or storage of a product. To this end, the present invention provides a container stopper comprising: a lower stopper (110) which is coupled to an inlet (10) of a container (10); and an upper stopper (120) which allows an opening (111) provided within the lower stopper (110) to be selectively opened and closed, wherein at least two locking parts (130) are formed so as to be spaced apart from
(Continued)

each other in the insertion direction on the inner circumferential surface of the opening (111) of the lower stopper (110) and on the outer circumferential surface of a sealing protrusion (121) of the upper stopper (120) coupled to the inner circumferential surface. The present invention as described above has the advantages of allowing the main locking position of the upper stopper coupled to the opening of the lower stopper to be formed so as to be inclined toward the end side of the sealing protrusion, thereby preventing the upper stopper from being easily opened by external shock, and also of improving the assembly strength of the upper stopper by applying the position of the locking parts to at least two points on the outer circumferential surface of the sealing protrusion.

4 Claims, 5 Drawing Sheets

(51) Int. Cl.
*B65D 51/18* (2006.01)
*B65D 39/00* (2006.01)
*B65D 43/16* (2006.01)

(52) U.S. Cl.
CPC ..... *B65D 43/169* (2013.01); *B65D 47/08* (2013.01); *B65D 47/0857* (2013.01); *B65D 51/18* (2013.01); *B65D 2251/009* (2013.01); *B65D 2251/0012* (2013.01); *B65D 2251/0021* (2013.01); *B65D 2251/0025* (2013.01); *B65D 2251/0028* (2013.01); *B65D 2251/0075* (2013.01); *B65D 2251/0087* (2013.01)

(58) Field of Classification Search
CPC .... B65D 2251/0012; B65D 2251/0087; B65D 2251/0075; B65D 2251/0028; B65D 2251/0025; B65D 2251/009; B65D 2251/0021
USPC ..... 215/355–364, 50–55, 296, 294, 299
See application file for complete search history.

(56) References Cited

U.S. PATENT DOCUMENTS

| | | | | | |
|---|---|---|---|---|---|
| 4,345,607 | A * | 8/1982 | Contreras | A45C 11/24 | 16/227 |
| 4,394,922 | A * | 7/1983 | Wimmer | B65D 39/16 | 215/300 |
| 4,589,431 | A * | 5/1986 | Yuhara | A45D 40/22 | 132/301 |
| 5,299,702 | A * | 4/1994 | Kneer | B65D 39/16 | 215/256 |
| 5,810,207 | A * | 9/1998 | Hayashida | B65D 41/485 | 215/237 |
| 6,283,317 | B1 * | 9/2001 | Benoit-Gonin | B65D 47/0838 | 215/235 |
| 8,365,932 | B2 * | 2/2013 | Lancesseur | B65D 41/485 | 215/235 |
| 2004/0245286 | A1 | 12/2004 | Lee | | |

FOREIGN PATENT DOCUMENTS

| | | | |
|---|---|---|---|
| JP | 07-291276 | A | 7/1995 |
| JP | 2006-089109 | A | 6/2006 |
| JP | 2009-029447 | A | 2/2009 |
| KR | 10-2002-0075346 | A | 8/2002 |
| KR | 20-0425667 | | 9/2006 |
| KR | 20-2009-0002566 | U | 9/2007 |
| KR | 20-0445206 | | 7/2009 |
| KR | 20-2009-0003957 | U | 1/2010 |
| KR | 10-1453547 | | 10/2014 |

OTHER PUBLICATIONS

Japanese Office Action, dated Apr. 3, 2018, 4 pages.
1st Office Action, dated Apr. 17, 2018, to Singapore Application No. 11201705454R, 7 pages.

* cited by examiner

【Fig. 1】
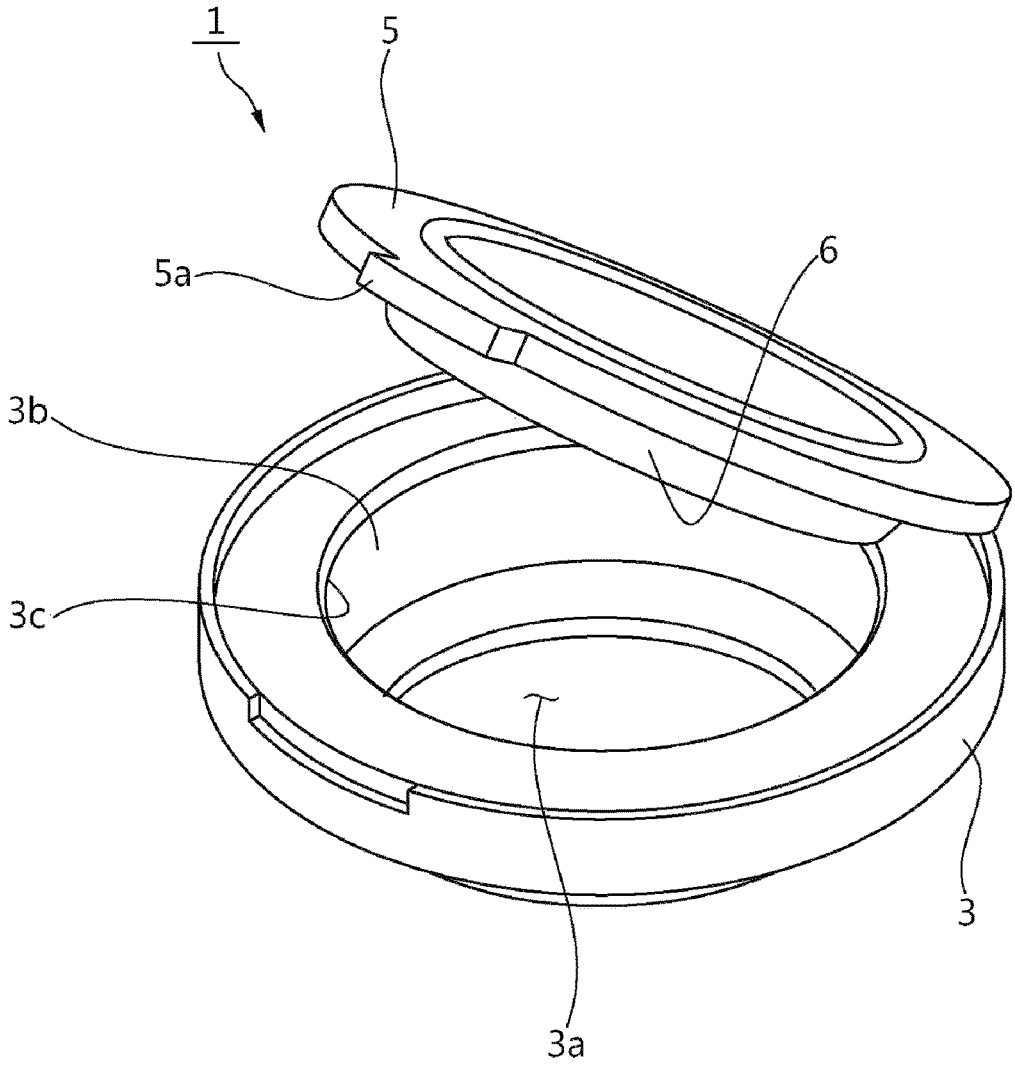

【Fig. 2】
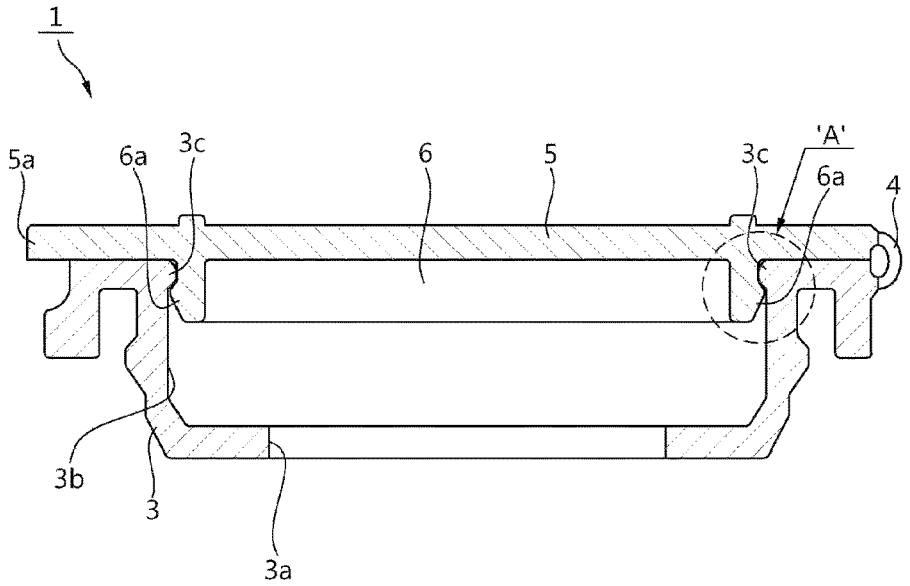
【Fig. 3】
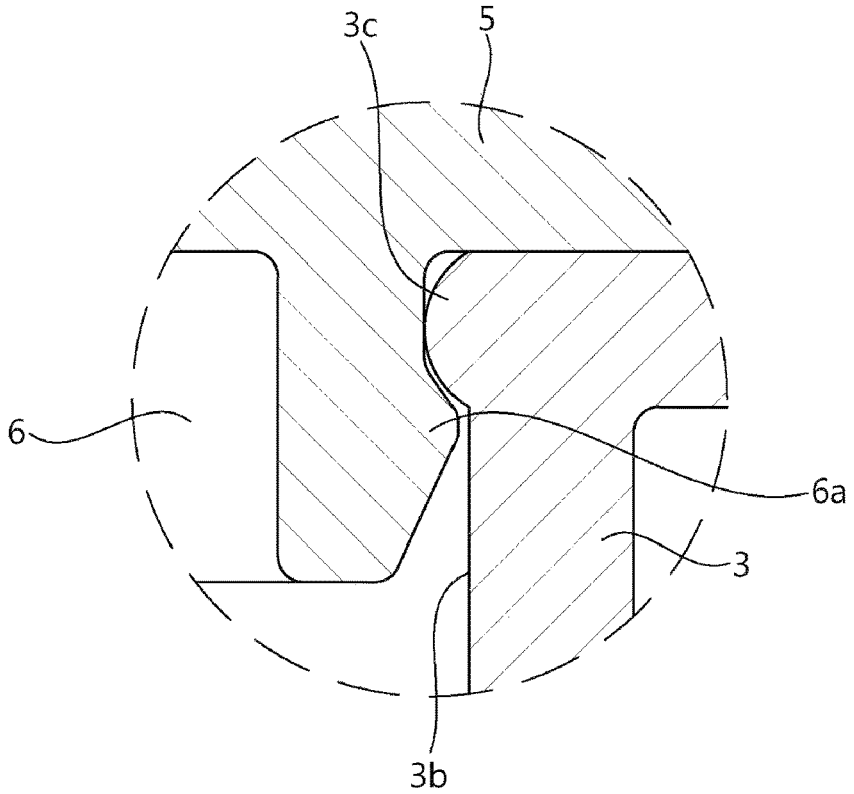

【Fig. 4】
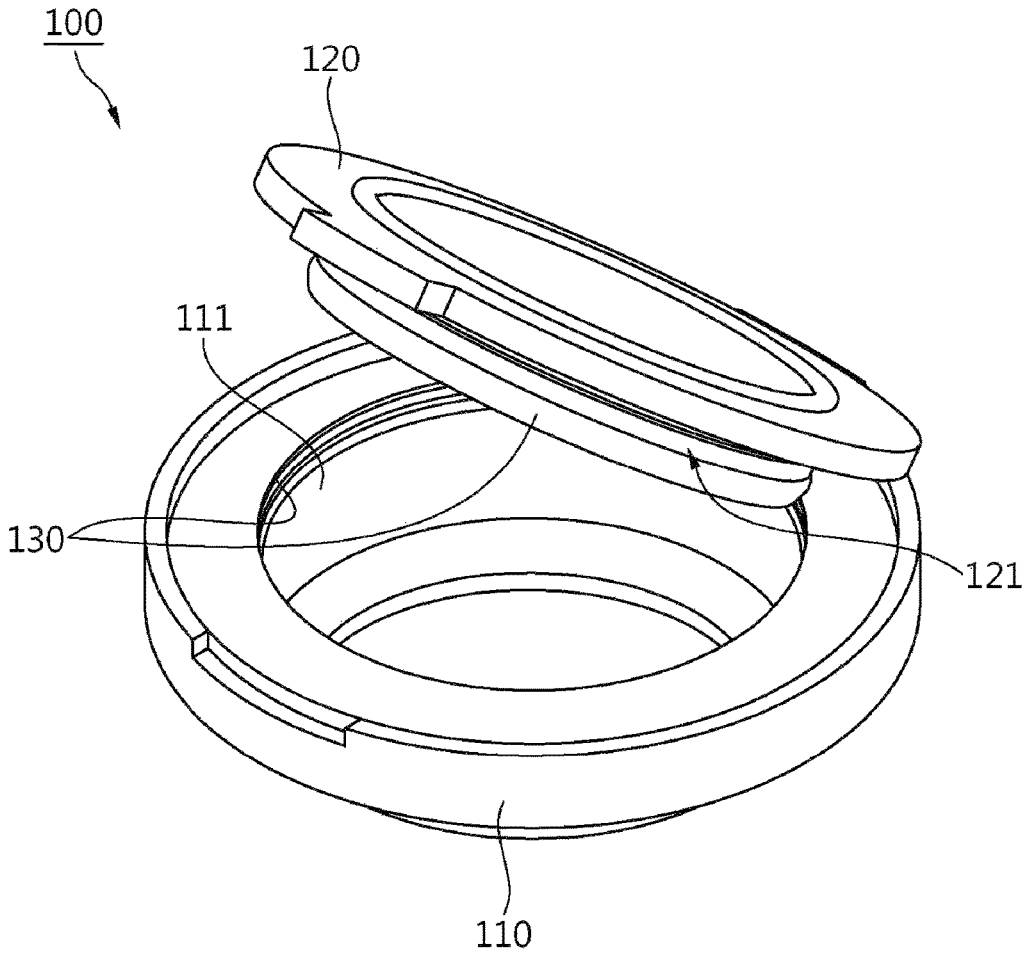

【Fig. 5】
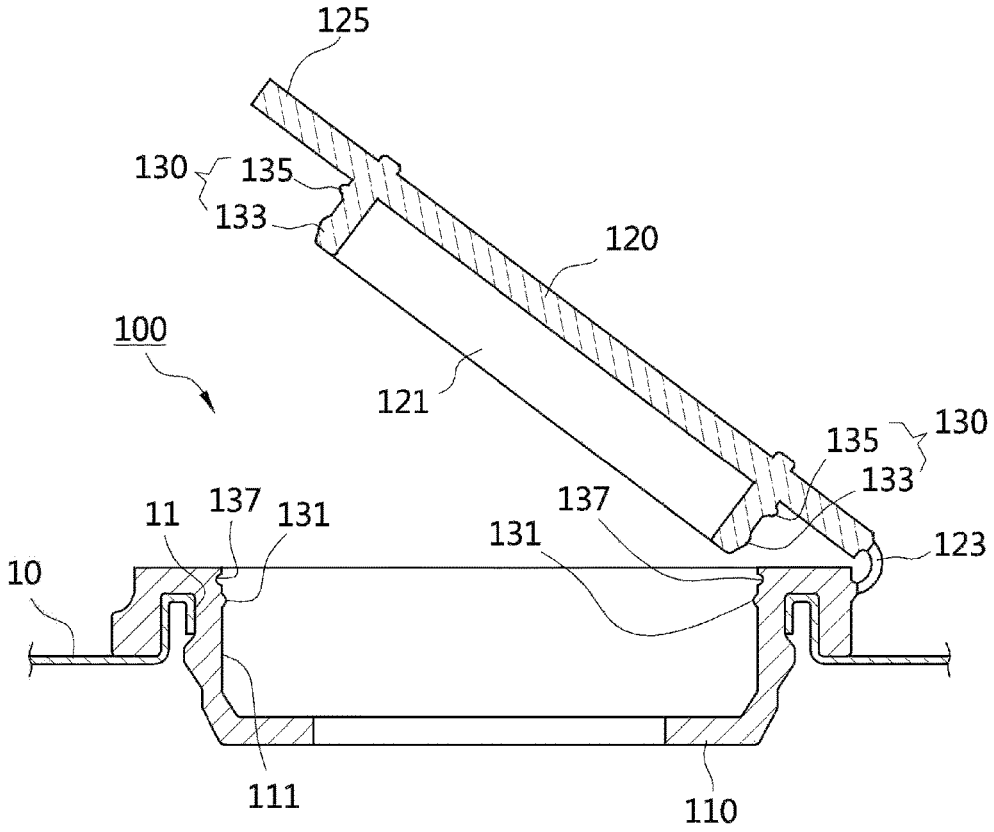
【Fig. 6】
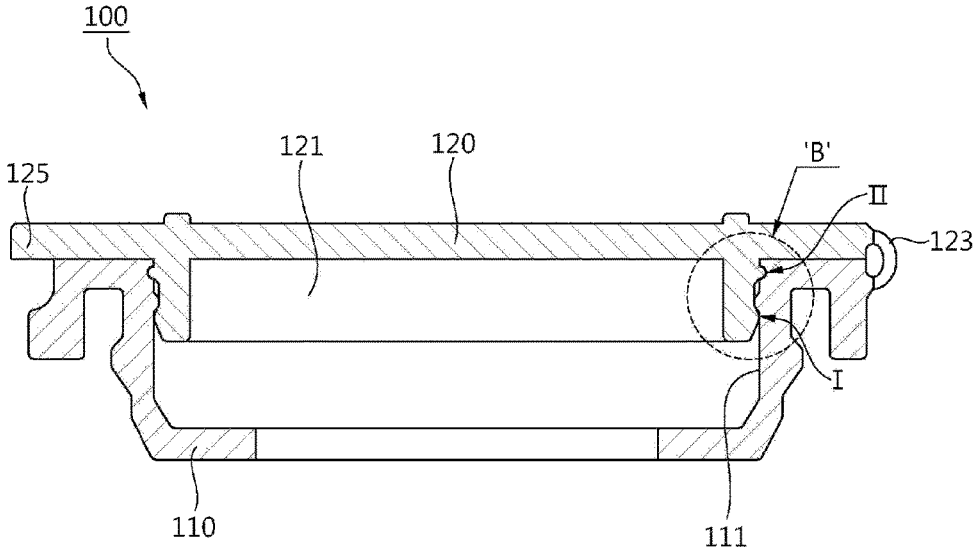

【Fig. 7】
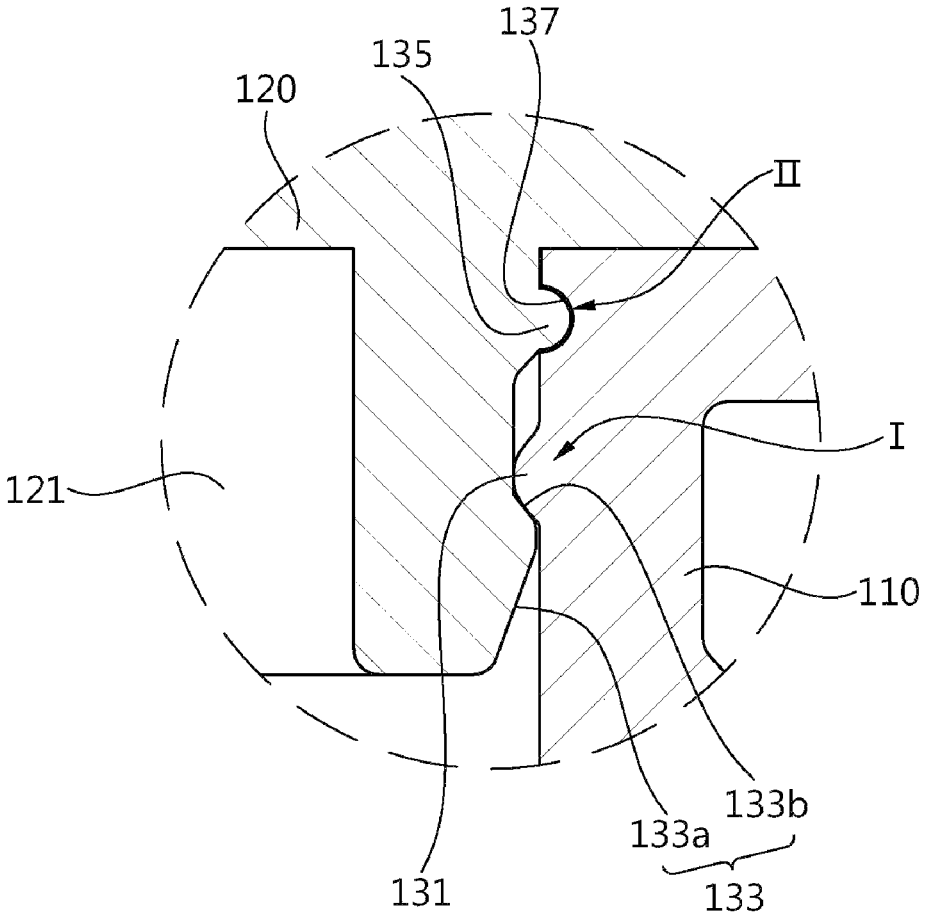

CONTAINER STOPPER HAVING MULTI-LOCK STRUCTURE

RELATED APPLICATIONS

This application is a 35 U.S.C. § 371 national phase application of PCT/KR2015/014430(WO2016/108590), filed on Dec. 29, 2015, entitled "Container stopper having multi-lock structure", which application claims the benefit of Korean Utility Model No. KR 20-2015-000000.1, filed Jan. 2, 2015, which is incorporated herein by reference in its entirety.

TECHNICAL FIELD

The present invention relates to a container stopper, and more particularly, to a container stopper having a multi-locking structure that is capable of preventing an upper stopper part coupled to a lower stopper part from easily opening from the lower stopper part due to shocks generated during the distribution process or storage of a product or due to other external forces.

BACKGROUND ART

Generally, liquids used for cooking in a kitchen, such as a variety of oils and sources, and the like, are stored in containers. An openable/closable stopper is coupled to an inlet of the liquid container. Conventional container stoppers have been disclosed in Korean Utility Model Registration Nos. 20-0445206 and 20-0425667.

Referring to FIG. 1, an example of the conventional container stoppers will be in detail explained. The conventional container stopper 1 includes a lower stopper part 3 coupled to an inlet of a container and an upper stopper part 5 for selectively opening and closing an opening 3*b* of the lower stopper part 3. The lower stopper part 3 and the upper stopper part 5 are connected unitarily with each other by means of a hinge band 4 so that the upper stopper part 5 can perform the swing opening and closing manipulation, without being lost. Further, the lower stopper part 3 has an inlet and outlet hole 3*a* formed at the inside thereof in such a manner as to have a smaller diameter than the inlet of the container, and through the inlet and outlet hole 3*a*, an appropriate amount of liquid can be discharged from the container.

In this case, a handle 5*a* is disposed on one side of the upper stopper part 5 to allow the opening and closing manipulation of the upper stopper part 5 to be easily carried out. Further, a sealing protrusion portion 6 is formed protrudingly from one surface of the upper stopper part 5 in such a manner as to be coupled to the inner circumferential surface of the opening 3*b* of the lower stopper part 3 to seal the inlet and outlet hole 3*a* of the lower stopper part 3. Furthermore, a locking projection 6*a* is formed protrudingly from the outer circumference surface of the sealing protrusion portion 6 in such a manner as to be locked correspondingly onto a stepped projection 3*c* formed on the outside edge of the opening 3*b* of the lower stopper part 3.

However, the conventional container stopper 1 has one coupling structure between the stepped projection 3*c* and the locking projection 6*a* so as to maintain the coupled state of the upper stopper part 5, and in this case, most of the locking portion of the upper stopper part 5 is located on the outside edge of the lower stopper part 3. In more detail, the shock applied from the outside is transmitted just to the locking portion of the upper stopper part 5.

Accordingly, undesirably, the upper stopper part 5 may open easily due to the shock generated during the distribution process or storage of the product or due to an external force not applied thereto such as incomplete capping, contamination caused by the content (oil, etc.), and the like.

In addition, the fixed force of the upper stopper part 5 to the lower stopper part 3 may become weakened due to the abrasion of the locking projection 6*a* caused while the upper stopper part 5 is being repeatedly open and closed to use the content contained in the container.

DISCLOSURE

Technical Problem

Accordingly, the present invention has been made in view of the above-mentioned problems occurring in the prior art, and it is an object of the present invention to provide a container stopper having a multi-locking structure that is capable of allowing the multi-locking structure to be applied to the inner circumferential surface of an opening of a lower stopper part and to the outer circumferential surface of a sealing protrusion portion of an upper stopper part coupled to the opening of the lower stopper part, thereby preventing the upper stopper part from opening easily due to shocks generated during the distribution process or storage of a product or due to other external forces.

Technical Solution

To accomplish the above-mentioned object, according to the present invention, there is provided a container stopper having a multi-locking structure, including: a lower stopper part coupled to an inlet of a container; an upper stopper part having a sealing protrusion portion formed on one surface thereto in such a manner as to selectively open and close an opening formed inside the lower stopper part; and at least two locking parts formed spaced apart from each other on the inner circumferential surface of the opening of the lower stopper part and on the outer circumferential surface of the sealing protrusion portion of the upper stopper part 120 coupled to the inner circumferential surface of the opening.

According to the present invention, desirably, the locking parts includes: a first locking point formed on the circumference of the end portion of the sealing protrusion portion; and a second locking point formed on the outside circumference edge of the opening.

According to the present invention, desirably, the first locking point has a locking coupling structure in which a stepped projection is formed on the opening and a locking projection is formed on the sealing protrusion portion in such a manner as to be locked correspondingly onto the stepped projection.

According to the present invention, desirably, the locking projection includes: a slant surface slidingly coming into contact with one side of the stepped projection upon the insertion of the sealing protrusion portion into the opening; and a locking surface lockingly coupled to the other side of the stepped projection at the same time when the slant surface slides.

According to the present invention, desirably, the second locking point has a structure in which a protrusion protrudes from the sealing protrusion portion and a coupling groove is formed on the opening in such a manner as to insert the protrusion thereinto.

According to the present invention, desirably, the protrusion and the coupling groove have any one of a semicircular section and a polygonal section such as triangular, square, and trapezoidal sections.

Advantageous Effects

According to the present invention, the container stopper having a multi-locking structure according to the present invention is configured wherein the upper stopper part coupled to the opening of the lower stopper part has a main locking position located inclinedly to the circumference of the front end of the sealing protrusion portion, thereby preventing the upper stopper part from easily open due to the application of external shocks thereto, and further, the locking parts are located in such a manner as to have at least two locking points formed on the outer circumferential surface of the sealing protrusion portion, thereby improving the coupling strength of the upper stopper part.

DESCRIPTION OF DRAWINGS

FIG. 1 is a perspective view showing a conventional container stopper.

FIG. 2 is a side sectional view showing the closed state of an upper stopper part of FIG. 1.

FIG. 3 is a detailed sectional view showing a portion 'A' of FIG. 2.

FIG. 4 is a perspective view showing a container stopper having a multi-locking structure according to the present invention.

FIG. 5 is a side sectional view showing the container stopper of FIG. 4.

FIG. 6 is a side sectional view showing the closed state of an upper stopper part of FIG. 4.

FIG. 7 is a detailed sectional view showing a portion 'B' of FIG. 6.

MODE FOR INVENTION

Hereinafter, an explanation on the configuration and operation of a container stopper having a multi-locking structure according to the present invention will be in detail given with reference to the attached drawing.

In order to facilitate the general understanding of the present invention in describing the present invention, through the accompanying drawings, the same reference numerals will be used to describe the same components and an overlapped description of the same components will be omitted.

FIG. 4 is a perspective view showing a container stopper having a multi-locking structure according to the present invention, FIG. 5 is a side sectional view showing the container stopper of FIG. 4, and FIG. 6 is a side sectional view showing the closed state of an upper stopper part of FIG. 4.

Referring to FIGS. 4 and 5, a container stopper 100 having a multi-locking structure according to the present invention includes a lower stopper part 110 coupled to an inlet 11 of a container 10, an upper stopper part 120 having a sealing protrusion portion 121 formed on one surface thereto in such a manner as to selectively open and close an opening 111 formed inside the lower stopper part 110, and at least two locking parts 130 formed spaced apart from each other in a direction in which the upper stopper part 120 is inserted into the lower stopper part 110 on the inner circumferential surface of the opening 111 of the lower stopper part 110 and on the outer circumferential surface of the sealing protrusion portion 121 of the upper stopper part 120 coupled to the inner circumferential surface of the opening 111.

Now, the configuration of the container stopper 100 having a multi-locking structure according to the present invention will be in detail explained.

First, the locking parts 130 serve to prevent the upper stopper part 120 from opening due to shocks generated during the distribution process or storage of the liquid container product or due to external forces not applied thereto.

Referring in detail to FIG. 6, the locking parts 130 have a first locking point I formed on the circumference of the end portion of the sealing protrusion portion 121 and a second locking point II formed on the outside circumference edge of the opening 111. That is, the locking parts 130 having the plurality of locking points I and II spaced apart from each other by a given distance in such a manner as to allow the entire portion of the outer circumferential surface of the sealing protrusion portion 121 to be fittedly coupled to the opening 111, thereby allowing the rigid coupling state of the upper stopper part 120 to the lower stopper part 110 to be maintained well.

According to the present invention, for example, the locking parts 130 has the two locking points I and II, but only if the rigid coupling state of the upper stopper part 120 can be maintained, of course, the locking parts 130 may have two or more locking points, that is, three or four locking points.

Referring to FIG. 7, the first locking point I has a locking coupling structure in which a stepped projection 131 is formed on the inner circumferential surface of the opening 111 and a locking projection 133 is formed on the outer circumferential surface of the sealing protrusion portion 121 in such a manner as to correspond to the stepped projection 131.

In this case, the locking projection 133 includes a slant surface 133*a* slidingly coming into contact with one side of the stepped projection 131 upon the insertion of the sealing protrusion portion 121 into the opening 111 and a locking surface 133*b* lockingly coupled to the other side of the stepped projection 131 at the same time when the slant surface 133*a* slides.

Further, the second locking point II has a structure in which a protrusion 135 is formed protrudingly from the outer circumferential surface of the sealing protrusion portion 121 and a coupling groove 137 is formed on the inner circumferential surface of the opening 111 in such a manner as to insert the protrusion 135 thereinto.

In this case, the protrusion 135 and the coupling groove 137 have a semicircular section, but they may have any one of polygonal sections such as triangular, square, and trapezoidal sections. According to the present invention, for example, the protrusion 135 and the coupling groove 137 having the semicircular sectional shape will be discussed.

In this case, the coupling structure between the locking projection 133 and the stepped projection 131 and the coupling structure between the protrusion 135 and the coupling groove 137, which have different locking characteristics from each other, are combinedly applied to the container stopper 100 according to the present invention, so that when compared with the case wherein the plurality of locking parts 130 has only the coupling structure between the locking projection 133 and the stepped projection 131, it is possible to maintain a more rigid coupling state.

In more detail, the coupling structure between the locking projection 133 and the stepped projection 131 can achieve easy coupling, but it may have a relatively smaller coupling force than the coupling structure between the protrusion 135 and the coupling groove 137. Contrarily, the coupling structure between the protrusion 135 and the coupling groove 137 can have a greater coupling force than the coupling structure between the locking projection 133 and the stepped projection 131, but it may have a relatively low coupling convenience in inducing gentle coupling.

Accordingly, the locking parts 130 do not have the two coupling structures having the same as each other, and as mentioned above, that is, they adopt the different coupling structures from each other, thereby desirably improving both of the coupling force and the coupling convenience.

According to the present invention, for example, the stepped projection 131 and the locking projection 133 are formed on the first locking point I, and the protrusion 135 and the coupling groove 137 are on the second locking point II, which is of course not limited thereto. That is, the protrusion 135 and the coupling groove 137 may be formed on the first locking point I, and the stepped projection 131 and the locking projection 133 may be on the second locking point II.

A referent numeral '123' not explained yet denotes a hinge band, and a reference numeral '125' denotes a handle.

As described above, the container stopper 100 having a multi-locking structure according to the present invention is configured wherein the upper stopper part 120 coupled openably and closably to the opening 111 of the lower stopper part 110 has the main locking position located more inclinedly on the circumference of the end portion of the sealing protrusion portion 121 (that is, on the circumference of the front end of the insertion direction of the sealing protrusion portion 121)) when compared with the conventional container stopper, so that even if an external shock is applied to the upper stopper part 120, the upper stopper part 120 cannot open easily.

Particularly, the locking parts 130 are located in such a manner as to have at least two locking points formed on the outer circumferential surface of the sealing protrusion portion 121 and on the inner circumferential surface of the opening 111, and further, the shapes and structures of the locking parts 130 are different from each other to improve the coupling strength of the upper stopper part 120.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

EXPLANATIONS OF REFERENCE NUMERALS IN THE DRAWING

10: container
11: inlet
100: container stopper
110: lower stopper part
111: opening
120: upper stopper part
121: sealing protrusion portion
130: locking part
131: stepped projection
133: locking projection
133*a*: slant surface
133*b*: locking surface
135: protrusion
137: coupling groove
I: first locking point
II: second locking point

The invention claimed is:

1. A container stopper having a multi-locking structure, comprising:

a lower stopper part coupled to an inlet of a container;

an upper stopper part selectively opening and closing an opening formed inside the lower stopper part; and at least two locking parts formed spaced apart from each other on an inner circumferential surface of the opening formed inside the lower stopper part and on an outer circumferential surface of a sealing protrusion portion of the upper stopper part coupled to the inner circumferential surface of the opening, wherein the locking parts comprise a locking coupling structure wherein the locking parts comprise a first locking point formed on a circumference of an end portion of the sealing protrusion portion;

wherein the first locking point has a locking coupling structure in which a stepped projection is formed on the opening and a locking projection is formed on the sealing protrusion portion in such a manner as to be locked correspondingly onto the stepped projection, and wherein the locking projection comprises a slant surface slidingly coming into contact with one side of the stepped projection upon the insertion of the sealing protrusion portion into the opening and a locking surface lockingly coupled to the other side of the stepped projection at the same time when the slant surface slides.

2. The container stopper according to claim 1, wherein the locking parts comprise a second locking point formed on an outside circumference edge of the opening.

3. The container stopper according to claim 2, wherein the second locking point comprises a protrusion protruding from the sealing protrusion portion and a coupling groove is formed on the opening in such a manner as to insert the protrusion therein.

4. The container stopper according to claim 3, wherein the protrusion and the coupling groove have any one of a semicircular section and a polygonal section.

* * * * *